US008021145B2

(12) United States Patent
Pompe et al.

(10) Patent No.: US 8,021,145 B2
(45) Date of Patent: Sep. 20, 2011

(54) GAS BURNERS

(75) Inventors: Anthony Lawrence Alfred Pompe, North Wales (GB); Kallis Haralambous, Sutton Coldfield (GB)

(73) Assignee: Neat Gas Burners Limited, London (GB)

( * ) Notice: Subject to any disclaimer, the term of this patent is extended or adjusted under 35 U.S.C. 154(b) by 313 days.

(21) Appl. No.: 10/543,221

(22) PCT Filed: Jan. 22, 2004

(86) PCT No.: PCT/GB2004/000183

§ 371 (c)(1),
(2), (4) Date: Nov. 3, 2005

(87) PCT Pub. No.: WO2004/065850

PCT Pub. Date: Aug. 5, 2004

(65) Prior Publication Data

US 2006/0194162 A1 Aug. 31, 2006

(30) Foreign Application Priority Data

Jan. 23, 2003 (GB) ..... 0301629.2

(51) Int. Cl.
*F23D 14/62* (2006.01)

(52) U.S. Cl. ..... 431/354; 431/8; 431/350

(58) Field of Classification Search ..... 431/354, 431/350, 8

See application file for complete search history.

(56) References Cited

U.S. PATENT DOCUMENTS

| | | | | |
|---|---|---|---|---|
| 1,340,226 | A | 5/1920 | Igou | |
| 3,574,507 | A | 4/1971 | Kydd | |
| 3,624,743 | A * | 11/1971 | Dills | 126/39 D |
| 3,687,602 | A | 8/1972 | Vignes | |
| 3,693,887 | A * | 9/1972 | Brodlin et al. | 239/500 |
| 4,566,268 | A * | 1/1986 | Hoffeins et al. | 60/39.463 |
| 4,643,670 | A | 2/1987 | Edwards et al. | |
| 4,701,123 | A | 10/1987 | Tallman et al. | |
| 4,767,319 | A | 8/1988 | Vosper | |
| 4,895,514 | A * | 1/1990 | Cantryn et al. | 431/350 |
| 5,879,154 | A | 3/1999 | Suchovsky | |
| 5,984,673 | A * | 11/1999 | Bossetti | 432/121 |

FOREIGN PATENT DOCUMENTS

| | | |
|---|---|---|
| FR | 2 469 654 | 5/1981 |
| FR | 7928638 | * 5/1981 |
| GB | 474777 | 11/1937 |
| GB | 1273151 | 3/1968 |

OTHER PUBLICATIONS

International Search Report for PCT/GB2004/000183, mailed Jul. 9, 2004.

* cited by examiner

*Primary Examiner* — Alfred Basichas
(74) *Attorney, Agent, or Firm* — Greenlee Sullivan P.C.

(57) ABSTRACT

A gas burner comprising a gas supply element having an outlet, and a gas deflector disposed adjacent the outlet, the position of the deflector, relative to the outlet, being adjustable so as to allow the extent of deflector-induced aeration to be altered.

18 Claims, 2 Drawing Sheets

GAS BURNERS

CROSS-REFERENCE TO RELATED APPLICATIONS

This application is the U.S. National Stage of International Application No. PCT/GB2004/000183, filed Jan. 22, 2004, which claims the benefit of Great Britain Patent Application No. 0301629.2, filed Jan. 23, 2003, which are hereby incorporated by reference in their entireties to the extent not inconsistent with the disclosure herein.

FIELD OF THE INVENTION

The present invention relates to gas burners, and particularly, but by no means exclusively, to so-called neat gas burners, in which no or a minimal amount of air is mixed with the feed gas upstream of the area of combustion. Such burners find application, for example, in commercial cooking appliances such as fryers.

BACKGROUND TO THE INVENTION AND OVERVIEW OF THE PRIOR ART

Gas burners are well-known and are used in a wide variety of applications. A typical gas burner may include a burner bar in, the form of a conduit having a gas inlet and one or more openings along its length to provide gas outlets through which the gas is emitted, prior to combustion. The gas is emitted in the form of jets, which are ignited to produce heat. For most domestic applications, natural gas (a "second family" gas) is used as the fuel, although "third family" gases such as liquid petroleum gas (LPG), butane and propane may also be used. Using these types of gas can require that a large amount of air be available to ensure complete combustion, and this has led to the use of a "pre-aeration" stage in conventional gas burners, typically comprising a short tube in which the air and gas are mixed before the mixture is emitted through the gas outlets. Although this pre-aeration stage helps to achieve complete combustion of the gas, it adds to the cost and complexity of manufacturing gas burners.

In an attempt to overcome this problem, the technology of neat gas burners has been used. In such burners, no pre-aeration chamber or process are used, upstream of the area of combustion, and thus neat gas burners can be cheaper and simpler to manufacture.

This type of burner was originally developed to burn "first family" town gas, which is derived from coal, and which does not require as much air as second and third family gases for complete combustion. In adapting this type of burner to use second and third family gases, it was found that there was insufficient air present for complete combustion to occur. To alleviate this, neat gas burners for second and third family gases have tended to include a baffle near the gas outlets such that gas escaping from the outlets is deflected by the baffle, resulting in turbulence, which causes the gas to mix with the surrounding air. The mixture of gas and air is ignited at the point where the gas hits the baffle, resulting in combustion of the gas.

SUMMARY OF THE INVENTION

According to a first aspect of the present invention, there is provided a gas burner comprising a gas supply element having an outlet, and a gas deflector disposed adjacent the outlet;

the position of the deflector, relative to the outlet, being adjustable so as to allow the extent of deflector-induced aeration to be altered.

The angle of the deflector; relative to the outlet, may be adjustable.

The spacing of the deflector, relative to the outlet, may be adjustable.

Preferably both the angle and spacing of the deflector, relative to the outlet, are adjustable.

The supply element may comprise a conduit having a plurality of spaced outlets, the deflector being provided by a baffle surface adjacent the outlets, such that gas emitted therefrom is incident upon spaced regions of the baffle surface.

The conduit may be a closed pipe, conveniently being generally straight, with the baffle surface extending generally parallel thereto.

Preferably, the baffle surface is generally flat.

The baffle surface may be inclined relative to the gas streams emitted through the outlets.

The baffle surface may have a distal ridge, with the distance of the distal ridge from the gas steams desirably being adjustable.

The gas burner may further comprise an air guide to assist in the entrainment of air with gas emitted from the outlet.

The air guide may have guide surfaces disposed on at least two sides of the outlet.

The outlet may be generally horizontally-disposed, with the guide surfaces being disposed above and below the outlet.

According to a second aspect of the invention, there is provided a gas burner comprising a gas supply element having an outlet for the emission of a gas stream and a gas deflector disposed adjacent the outlet to assist in the aeration of the gas prior to combustion, the baffle surface of the deflector being inclined to the gas stream at between 40° and 50°.

The baffle surface may be inclined at between 44° and 46°, but preferably is inclined to the gas stream at approximately 45°.

The deflector may be positioned such that the gas stream hits the deflector at a region whose height is approximately two thirds of the height of the deflector, taken from the base thereof.

This has been found to increase the stability of the flame produced by the combustion of the gas.

Advantageously, the deflector is coated with or made from a ceramic or ceramic fibre material, to reduce the amount of nitrogen oxides (NOx) produced by the combustion of the gas.

Specific and non-limiting embodiments of the aspects of the invention will now, be described, by way of example only, with reference to the accompanying drawings, in which.

Figure 1:
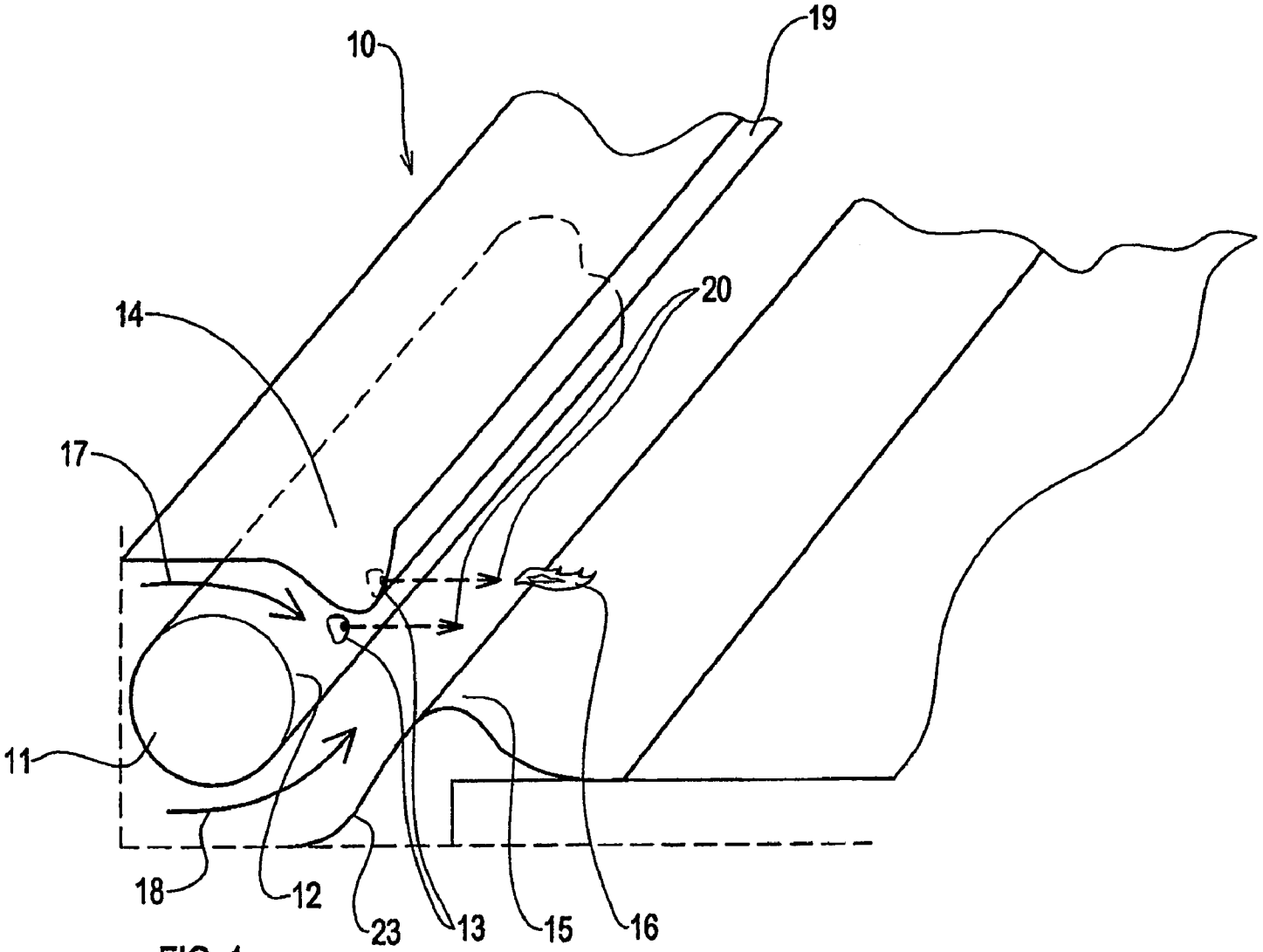
FIG. 1 shows a part cut-away perspective view of a gas burner according to the present invention.

Turning first to FIG. 1, a gas burner is shown generally at 10. The gas burner 10 has a burner bar 11 comprising a partly-sealed length of tubing 12 having a gas inlet (not shown) and a number of gas outlets 13, formed by drilled holes in the tubing 12. The gas outlets 13 are spaced so as to allow easy cross-lighting of gas streams issuing from the gas outlets 13. Optionally, gas nozzles (not shown) may be fitted to the gas outlets 13. Positioned above the burner bar 11 is an air guide plate 14, which is curved to correspond with the outer surface of the burner bar 11 so as to direct air towards the gas outlets 13, as indicated by arrow 17. The air guide plate 14 is fitted with a reinforcing lip 19 for added strength. Facing the gas outlets 13 is a deflector 15, mounted such that a front face (baffle surface) 23 of the deflector 15 is angled away from the gas outlets 13. In this example, the deflector is made from angle iron to prevent deformation of the deflector 15 at high temperatures, but other materials could also be used. In particular, the deflector 15 may be made from, or coated with, a ceramic or ceramic fibre material to help reduce the amount of nitrogen oxides (NOx) produced. The deflector 15 in this example has a generally triangular cross-section for strength.

However, it will be understood by those skilled in the art that the deflector 15 may have any suitable cross-section, or may be a single flat plate. The horizontal distance between the burner bar 11 and the deflector 15 is adjustable in accordance with the application for which the burner is to be used. The angle of the deflector relative to a horizontal plane is also adjustable, such that the angle at which the gas streams hit the front face 23 of the deflector 15 is adjustable, as explained in more detail below.

Figure 2:
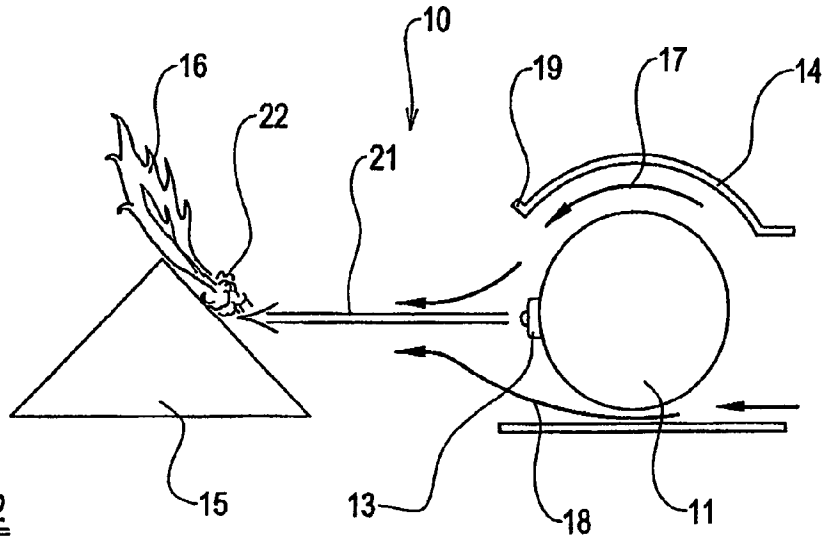
FIG. 2 shows a side view of the gas burner in operation.

Turning next to FIG. 2, a gas burner 10 is shown in use. Gas is supplied to the burner bar 11 through the gas inlet. Gas escapes from the burner bar 11, in the form of jets/streams 21, through the gas outlets 13. The escaping gas jets 21 hit the deflector 15 and experience turbulence 22, causing the gas to mix with atmospheric air surrounding the deflector 15. For many feed gases such as propane, this mixing of the gas with airs combined with the air directed towards the escaping gas jets 21 by the air guide plate 14 (indicated by arrows 17), and air from beneath the burner bar 11 (indicated by arrows 18), ensures that sufficient air is present to allow complete or near-complete combustion of the gas when it is ignited at the deflector 15. However, some gases, such as butane, require more air for complete or near-complete combustion. When such gases are used, an appropriate amount of air may be added to the feed gas stream at the inlet or in the burner bar 11, to ensure complete, or near-complete, combustion. In order to reduce problems caused by "feedback" of gas and/or combustion products, and to ensure that the necessary turbulence is created, the air introduced into the feed gas stream must be at a pressure greater than that of the feed gas. As will be understood by those skilled in the art, additional controls; which are known per se, may be required to ensure the safety and correct operation of such an arrangement. In either case, a fan-shaped flame 16, generally blue in colour, is produced at the deflector 15.

Figure 3:
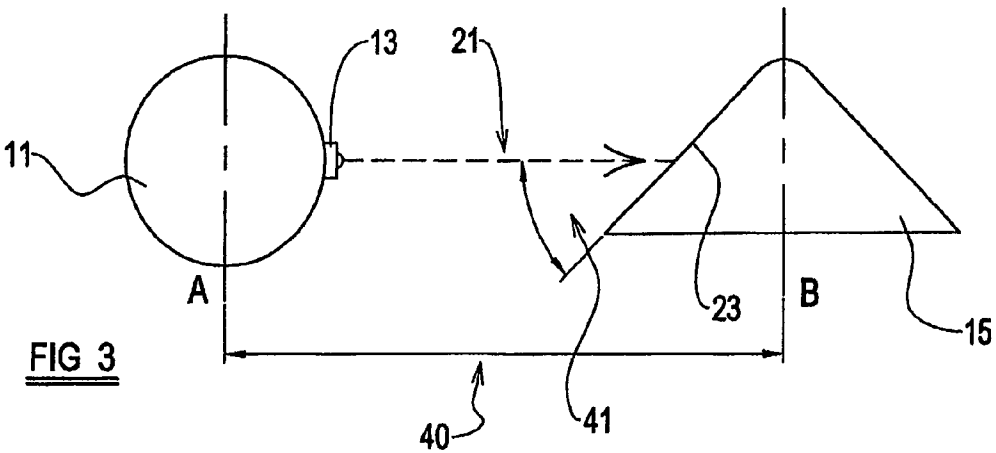
FIG. 3 shows a schematic view of the gas burner.

Turning lastly to FIG. 3, there is shown a schematic side view of a burner. Through testing, it has been found by the applicants that, for a given size of burner bar, the horizontal distance between the burner bar 11 and the deflector 15 (indicated by arrow 40) is dependent upon the required heat output of the burner 10. For small heat outputs, a small distance 40 is required, whereas for larger heat outputs, a larger distance 40 is required. It has, also been found by the applicants that the amount of aeration of the gas jets 21 issuing from the gas outlets 13 is dependent upon the angle 41 at which the gas jets 21 hit the deflector 15. For example, if the angle 41 is less than 44 degrees, less turbulence 22 is created at the deflector 15, which results in less aeration of the gas jets 21 and thus less complete combustion of the gas 21: Increasing the angle 41 above 46 degrees also reduces the amount of turbulence 22 created, again causing less complete combustion of the gas, as well as giving rise to a risk that the flame 16 will. 'lift off' the deflector 15, moving away from a position at which optimum heating occurs. It has been found that the optimum, angle 41 is 45 degrees to ensure correct aeration of the gas 21 and therefore complete or near-complete combustion. It has also been found that, for maximum stability of the flame 16, the point at which the gas 21 hits the deflector 15 should be approximately two-thirds of the height of the deflector 15 from the base of the deflector 15, as shown (approximately) in FIG. 2.

In the drawings the gas outlets 13 are shown to emit gas in a generally horizontal direction. It is to be understood that the present invention may equally be employed using gas outlets which emit gas in a more vertical direction, although for downward firing applications, it may be necessary to extract the combustion products so that they do not, interfere with the combustion process.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A neat gas burner comprising a gas supply element having an outlet for the emission of unlit gas;

an air guide positioned to direct air for combustion toward said outlet and to assist in the entrainment of air with unlit gas emitted from the outlet; and a gas deflector at a position spaced from the outlet, the gas deflector being provided with a baffle surface that is disposed in direct alignment with a central axis of the outlet such that unlit gas emitted from the outlet hits the baffle surface thereby causing turbulence to assist in the aeration of the gas, so as to allow combustion to occur at the deflector;

wherein no or a minimal amount of air is mixed with gas upstream of the position of combustion.

2. A gas burner according to claim 1 wherein the angle of the deflector, relative to the outlet, is adjustable.

3. A gas burner according to claim 1 wherein the spacing of the deflector, relative to the outlet, is adjustable.

4. A gas burner according to claim 1, wherein the angle and spacing, relative to the outlet, is adjustable.

5. A gas burner according to claim 1 wherein the supply element comprises a conduit having a plurality of spaced outlets, such that gas emitted therefrom is incident upon spaced regions of the baffle surface.

6. A gas burner according to claim 5 wherein the conduit is a closed pipe, the pipe being generally straight, with the baffle surface extending generally parallel thereto.

7. A gas burner according to claim 5 wherein the baffle surface is generally flat.

8. A gas burner according to claim 5, wherein the baffle surface is inclined relative to the gas streams emitted through the outlets.

9. A gas burner according to claim 5, wherein the baffle surface has a distal ridge.

10. A gas burner according to claim 9 wherein the distance of the distal ridge from the gas steams is adjustable.

11. A gas burner according to claim 1 wherein the air guide has guide surfaces disposed on at least two sides of the outlet.

12. A gas burner according to claim 11 wherein the outlet is generally horizontally-disposed, with the guide surfaces being disposed above and below the outlet.

13. A gas burner according to claim 1 wherein the deflector is positioned such that the gas stream hits the deflector at a region whose height is approximately two thirds of the height of the deflector, taken from the base thereof.

14. A gas burner according to claim 1 wherein the position of the deflector, relative to the outlet, is adjustable so as to allow the extent of deflector-induced aeration to be altered.

15. A neat gas burner comprising a gas supply element having an outlet for the emission of an unlit gas stream;

an air guide positioned to direct air for combustion toward said outlet and to assist in the entrainment of air with unlit gas emitted from the outlet; and a gas deflector at a position spaced from the outlet, the deflector being provided with a baffle surface that is disposed in direct alignment with a central axis of the outlet, such that the gas stream hits the baffle surface thereby causing turbulence to assist in the aeration of the gas, so as to allow combustion to occur at the deflector, and the baffle surface being inclined to the gas stream at between 40° and 50°;

wherein no or a minimal amount of air is mixed with gas upstream of the position of combustion.

16. A gas burner according to claim 15 wherein the baffle surface is inclined at between 44° and 46°.

17. A gas burner according to claim 15 wherein the baffle surface is inclined to the gas stream at approximately 45°.

18. A gas burner according to claim 15 wherein the position of the deflector, relative to the outlet, is adjustable so as to allow the extent of deflector-induced aeration to be altered.

* * * * *